United States Patent [19]

Nagase

[11] 4,418,665

[45] Dec. 6, 1983

[54] METHOD OF AND APPARATUS FOR CONTROLLING THE AIR INTAKE OF AN INTERNAL COMBUSTION ENGINE

[75] Inventor: Masaomi Nagase, Toyota, Japan

[73] Assignee: Toyota Jidosha Kogyo Kabushiki Kaisha, Toyota, Japan

[21] Appl. No.: 303,108

[22] Filed: Sep. 17, 1981

[30] Foreign Application Priority Data

Sep. 24, 1980 [JP] Japan ..... 55-131461

[51] Int. Cl.[3] ..... F02M 23/06

[52] U.S. Cl. ..... 123/339; 364/431.07

[58] Field of Search ..... 123/339, 585; 364/431.07

[56] References Cited

U.S. PATENT DOCUMENTS 4,240,145 12/1980 Yano et al. ..... 123/585 X 4,345,557 8/1982 Ikeura ..... 123/339

*Primary Examiner*—Tony M. Argenbright

*Attorney, Agent, or Firm*—Cushman, Darby & Cushman

[57] ABSTRACT

The sectional area of a bypass passage which is bypassing a throttle valve in an intake passage of an internal combustion engine is additionally increased or decreased responsive to whether at least one predetermined load is applied or not. The quantity of the additionally increasing or decreasing area is determined in accordance with a first value which corresponds to a desired idling rotational speed when the predetermined load is applied to the engine, and with a second value which corresponds to a desired idling rotational speed when the predetermined load is not applied to the engine.

10 Claims, 15 Drawing Figures

| Fig. 5a | Fig. 5b |
|---|---|

METHOD OF AND APPARATUS FOR CONTROLLING THE AIR INTAKE OF AN INTERNAL COMBUSTION ENGINE

BACKGROUND OF THE INVENTION

The present invention relates to a method of and apparatus for controlling the flow rate of air intake of an internal combustion engine, particularly during idling.

There is known a method of controlling the air intake of an internal combustion engine when a throttle valve disposed in an intake passage is at the fully closed position. According to this conventional method, the flow rate of intake air, when the throttle valve is fully closed, is controlled by means of a control valve disposed in an air bypass passage which interconnects the intake passage at a position located upstream of the throttle valve with the intake passage at a position located downstream of the throttle valve. Such an air intake control method is usually employed for controlling the idling rotational speed of the engine. The idling rotational speed can be controlled by a closed loop if the bypass control valve is adjusted to control the flow rate of the air sucked into the engine through the bypass passage so that the detected actual rotational speed of the engine becomes equal to the desired idling rotational speed.

If a load is placed on the engine during idling, (e.g., the air) conditioner driven by the engine is operated or the shift position of the automatic transmission is changed from the neutral range or the parking range (these ranges are hereinafter referred to as the N range) to another range, such as the drive range (hereinafter referred to as D range) during the idling condition) a drive signal for actuating the bypass control valve is increased (or sometimes decreased) by a predetermined value independent of the above-mentioned closed loop control operation to increase (or decrease) the flow rate of air passing through the air bypass passage by a predetermined amount. If the exerted load is removed during idling (,e.g. if the air conditioner is switched off or if the shift position of the automatic transmission is changed from the D range to the N range, the drive signal is decreased by a predetermined value causing the bypass air-flow rate to be decreased by a predetermined amount. Thus, the response of the engine during idling can be improved by additionally increasing or decreasing the bypass air-flow rate by an amount which corresponds to the applied or removed load.

However, according to the conventional technique, since the additionally increased or decreased amount of the bypass air-flow rate responsive to the application or removal of the fixed load is always maintained at a predetermined fixed value, the following problems occur. For example, if a desired idling rotational speed, such as when the air conditioner is operating (when the air conditioner actuating switch is in an on-condition) is determined depending upon the atmospheric temperature (the temperature of the intake air or the temperature of air surrounding the engine), if the bypass air-flow rate is additionally increased or decreased by a common fixed amount in response to the on-off operation of the air conditioner actuating switch, the idling rotational speed of the engine may overshoot the desired value at the on-off operation of the air conditioner actuating switch causing torque-shocks to occur. Furthermore, due to the overshooting, the idling rotational speed is greatly delayed from converging to a desired speed, and thus the driving feeling of the engine is deteriorated. The same inconvenience during the on-off operation of the air conditioner actuating switch occurs when the automatic transmission is shifted from the D range to the N range and vice versa.

SUMMARY OF THE INVENTION

It is, therefore, an object of the present invention to provide a method of and apparatus for controlling the air intake of an internal combustion engine, whereby the idling rotational speed of the engine is smoothly and quickly controlled at the desired idling rotational speed without being overshot, even when a load is applied to or removed from the engine, causing the drive feeling to remarkably improve.

According to the present invention, at least one predetermined load is monitored to determine whether it has been applied to the engine. When it has been applied, a load discrimination signal is generated. The engine is monitored to produce a rotational speed signal which corresponds to the detected rotational speed. The produced rotational speed signal is compared with a variable reference rotational speed signal which indicates a desired idling rotational speed of the engine, to generate a control output signal for adjusting the bypassed section of an air bypass passage which bypasses the throttle valve, the desired idling rotational speed being determined depending upon the load discrimination signal. In response to the load discrimination signal, the control output signal is additionally increased or decreased by a value which is determined in accordance with a first value which corresponds to a desired idling rotational speed when the predetermined load is applied to the engine and with a second value which corresponds to a desired idling rotational speed when the predetermined load is not applied to the engine engine. In response to the control output signal, the sectional area of the air bypass passage is adjusted to control the flow rate of air drawn through the air bypass passage so as to reduce the difference between the actual rotational speed signal and the reference rotational speed signal.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
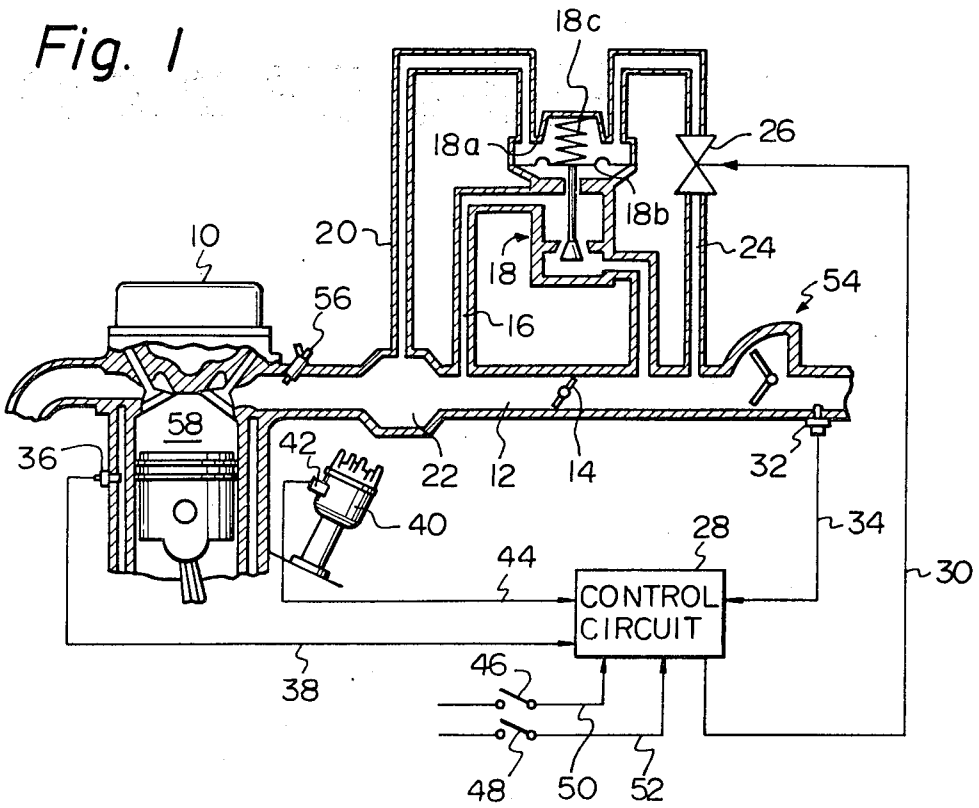
FIG. 1 is a schematic diagram illustrating a system in which the method of the present invention is used.

Referring to FIG. 1, in which an example of an electronic fuel injection control system of an internal combustion engine, according to the method of the present invention, is illustrated, a reference numeral 10 denotes an engine body, and 12 denotes an intake passage. A throttle valve 14 is disposed in the intake passage 12.

An air control valve (ACV) 18 is provided in an air bypass passage 16 which interconnects the intake passage 12 of the throttle valve with the intake passage 12 downstream of the throttle valve 14. The ACV 18 operates responsive to a vacuum pressure which is applied to a diaphragm chamber 18*a*, and controls the flow rate of air which passes through the air bypass passage 16. Namely, as the vacuum pressure increases in the diaphragm chamber 18*a*, a diaphragm 18*b* is pulled against a spring 18*c*, and the cross-sectional area of the flow passage is reduced to decrease the flow rate of the bypass air. Contrary to this, as the vacuum pressure decreases in the diaphragm chamber 18*a*, the diaphragm 18*b* is pushed by the spring 18*c*, whereby the cross-sectional area of the flow passage is increased to increase the bypass air flow rate.

The diaphragm chamber 18*a* of the ACV 18 communicates, via a conduit 20, with a surge tank 22 which is located on the downstream side of the throttle valve 14, and further communicates with the intake passage 12 on the upstream side of the throttle valve 14 via a conduit 24. A vacuum pressure switching valve (VSV) 26 is disposed in the conduit 24. The VSV 26 is operated by electrical signals that are sent from a control circuit 28 via a line 30 to control the vacuum pressure in the diaphragm chamber 18*a* of the ACV 18. Namely, as the VSV 26 is energized by an electrical current, the path opens so that the open air is permitted to flow into the diaphragm chamber 18*a* to decrease the vacuum pressure.

An air temperature sensor 32 is disposed in the most upstream portion of the intake passage 12 to detect the temperature of the air that is sucked into the engine. The analog voltage which represents the detected intake air temperature is fed to the control circuit 28 via a line 34.

A coolant temperature sensor 36 is disposed in the cylinder block of the engine to detect the temperature of the coolant, and an analog voltage which represents the detected coolant temperature is sent to the control circuit 28 via a line 38.

A distributor 40 is provided with a crank angle sensor 42 which produces a pulse at every predetermined angle rotation, for example, every time the crank shaft turns by 30° CA. The produced pulses are sent to the control circuit 28 via a line 44.

The control circuit 28 further receives a signal from an air conditioner actuating switch 46 which is turned on when the air conditioner is operated, and a signal from a neutral switch 48 which is turned on when the automatic transmission is shifted to the N range, via lines 50 and 52, respectively.

In electronic fuel injection control type internal combustion engines of this kind, as is well known, the flow rate of the air sucked into the engine is detected by an air flow sensor 54. Fuel, in an amount which corresponds to the detected flow rate of the intake air, is injected from a fuel injection valve 56 to produce the gas mixture which is fed to a combustion chamber 58. Therefore, if the flow rate of the bypass air through the air bypass passage 16 is controlled by the ACV 18 when the throttle valve 14 is at the idling position, the idling rotational speed of the engine is controlled depending upon the bypass air flow rate.

Figure 2:
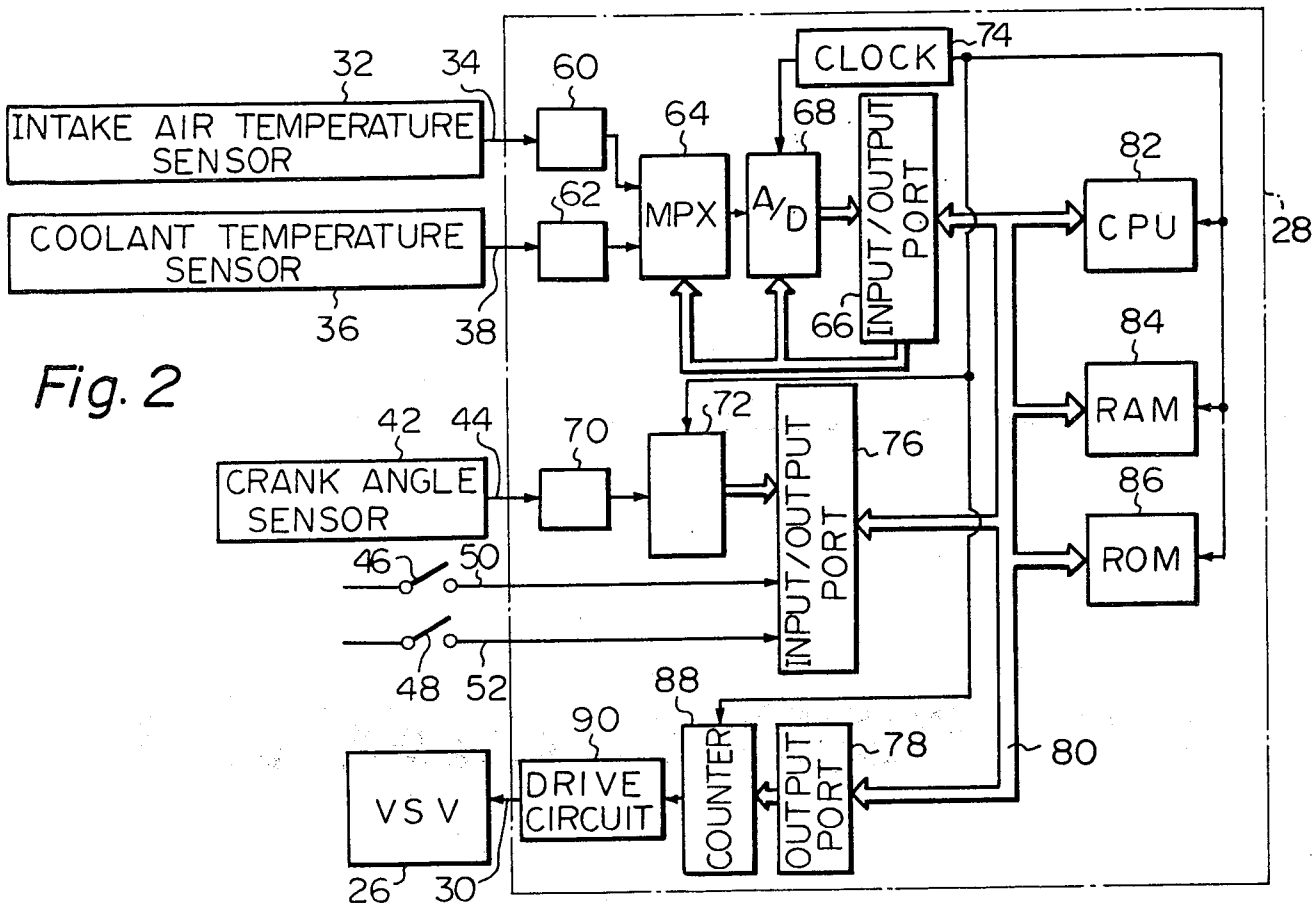
FIG. 2 is a block diagram illustrating a control circuit in the system of FIG. 1.

FIG. 2 is a block diagram which illustrates in detail the control circuit 28 of FIG. 1.

Voltage signals from the intake air temperature sensor 32 and the coolant temperature sensor 36 are fed to an analog multiplexer 64 via buffers 60 and 62, and are fed to an A/D converter 68 in sequence responsive to selection signals from an input/output port 66. In the A/D converter 68, the voltage signals are converted into signals in the form of a binary number. The converted binary signals are fed to the input/output port 66.

A pulse produced by the crank angle sensor 42 at every crank angle of 30° is fed to a speed signal-forming circuit 72 via a buffer 70. The speed signal-forming circuit 72 consists of a gate that is opened and closed by a pulse produced at every crank angle of 30°, and a counter which counts the number of clock pulses applied to the counter from a clock generator circuit 74 via the gate. The speed signal-forming circuit 72 forms speed signals in the form of a binary number which signals represent the actual rotational speed of the engine. The formed binary speed signals are applied to a predetermined bit position of an input/output port 76.

Signals from the air conditioner actuating switch 46 and the neutral switch 48 are applied to predetermined bit positions of the input/output port 76.

The input/output ports 66, 76, and an output port 78, which will be mentioned later, are connected via a bus 80, to a central processing unit (CPU) 82, a random access memory (RAM) 84, and a read-only memory (ROM) 86, which are major components constituting a microcomputer. The RAM 84 temporarily stores a variety of input data, the data used in the arithmetic calculation, and the results of the arithmetic calculations. In the ROM 86 have been stored beforehand a program for processing the arithmetic calculations that will be mentioned later, and a variety of data necessary for processing the arithmetic calculations.

A binary control output $D_{out}$ for controlling the VSV 26 is fed from the CPU 82 to the output port 78, and then is set to a presettable down counter 88. The down counter 88 starts to count down the operation with respect to the set content at every predetermined period of time, for example, at every 50 msec. Namely, the down counter 88 reduces the set content one by one to zero, in response to the clock pulses from the clock generator circuit 74. Thus, the output of the high level is fed to a drive circuit 90 during the count down operation. The drive circuit 90 energizes the VSV 26 as far as it is served with the output of the high level. Therefore, the VSV 26 is energized at a duty ratio which corresponds to the control output $D_{out}$. Consequently, the bypass air flow rate is controlled depending upon the control output $D_{out}$.

Below is illustrated an arithmetic calculation executed by the microcomputer. The CPU 82 in a main processing routine receives, from the input/output port 76, the newest data which represents the actual rotational speed $N_E$ of the engine and stores it is a predetermined region in the RAM 84. The RAM 84 also stores the data which have been applied to the input/output port 76 and which represent the positions of the air conditioner switch 46 and the neutral switch 48. Further, the newest data which represent the intake air temperature THA and the coolant temperature THW are stored in predetermined regions of the RAM 84, which newest data are applied in sequence to the input/output port 66 by an A/D conversion interrupt processing routine which is executed at every predetermined period of time.

Figure 3:
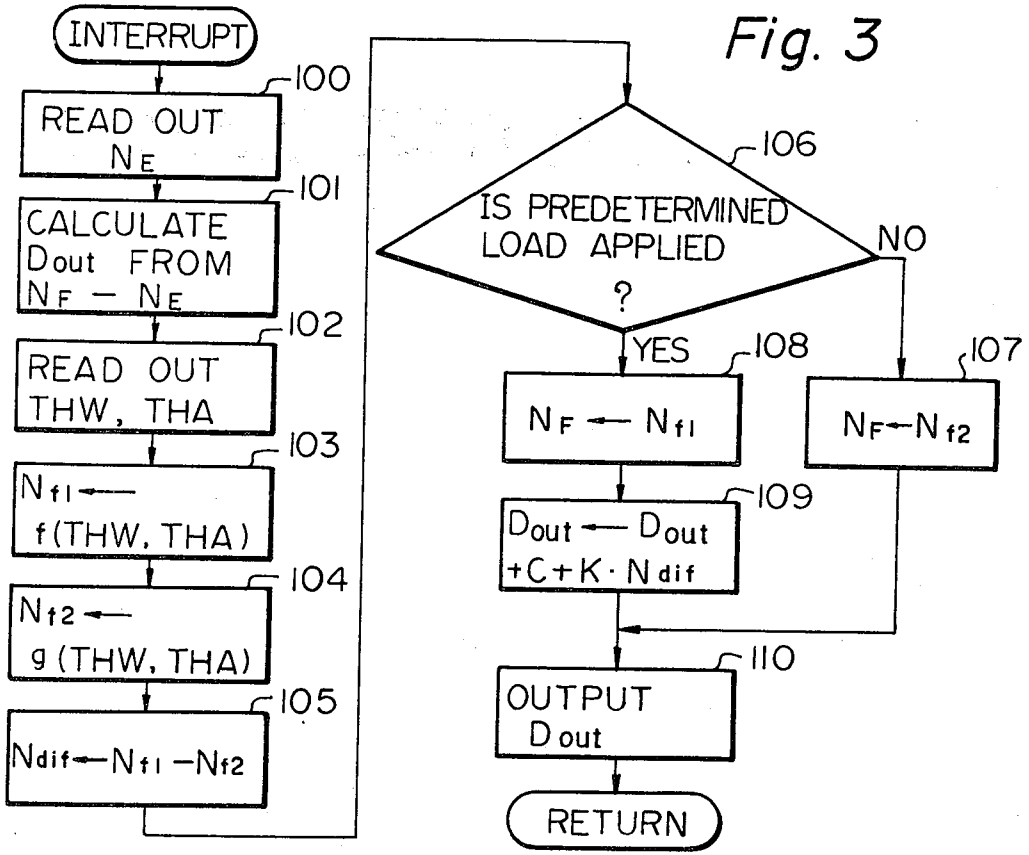
FIG. 3 is a flow diagram illustrating one operation of the digital computer in the control circuit of FIG. 2.

FIG. 3 illustrates an interrupt processing program for calculating the control output $D_{out}$. This program calculates the control output $D_{out}$ under a condition where the air conditioner is operated or not operated, or under a condition where the shift position of the automatic transmission is in the D range or in the N range.

The CPU 82 executes the interrupt processing routine of FIG. 3 at every predetermined period of time. First, at a point 100 the CPU 82 reads out from the RAM 84 a detection data related to the actual rotational speed $N_E$ of the engine, and at a point 101, calculates the control output $D_{out}$ based upon the difference between the actual rotational speed $N_E$ and a reference rotational speed $N_F$. The calculation in the point 101 can be performed according to one of the following two methods. One method is to find the control output $D_{out}$ according to a relation, $$D_{out}=D_{out'}+A.(N_F-N_E)$$

where $D_{out'}$ denotes a control output in the previous operation cycle and A denotes a constant. Another method is to find the control output $D_{out}$ employing a predetermined reference Value $D_O$ according to a relation, $$D_{out}=D_O+B.(N_F-N_E)$$

where B denotes a constant.

In the point 101 as mentioned above, the control output $D_{out}$ is increased or decreased responsive to the difference $N_F-N_E$. At a point 102, then, the detection data related to the coolant temperature THW and the intake air temperature THA are read out from the RAM 84. At a point 103, the CPU 82 finds a first desired idling rotational speed $N_{f1}$ which is to be maintained when a predetermined load is applied, i.e., the CPU 82 finds a first desired rotational speed $N_{f1}$ which is to be maintained when the air conditioner is operated or when the shift position of the automatic transmission is in the D range, relying upon a predetermined function of f(THW, THA).

Then, at a point 104, the CPU 82 find a second desired idling rotational speed $N_{f2}$ that is to be maintained when the predetermined load is not applied, i.e., the CPU 82 finds a second desired rotational speed $N_{f2}$ that is to be maintained when the air conditioner is not operated or when the shift position of the automatic transmission is in the N range, relying upon a function g(THW, THA) which has been determined beforehand with regard to THW and THA. Then, at a point 105, the difference $N_{dif}$ between the first desired rotational speed $N_{f1}$ and the second desired rotational speed $N_{f2}$ is calculated.

At a next point 106, the CPU 82 discriminates whether a predetermined load is exerted on the engine, based upon a signal from the air conditioner switch 46 or upon a signal from the neutral switch 48. When no load is exerted on the engine, the program proceeds to a point 107 where the reference rotational speed $N_F$ is brought into agreement with $N_{f2}$. When the load is exerted, the program proceeds to a point 108 where the reference rotational speed $N_F$ is brought into agreement with $N_{f1}$. At a point 109, the CPU 82 increases the control output $D_{out}$ by an amount $c+K.N_{dif}$ where C and K denote constants. Then, at a point 110, the calculated control output $D_{out}$ is fed to the output port 78 (FIG. 2).

Figure 4:
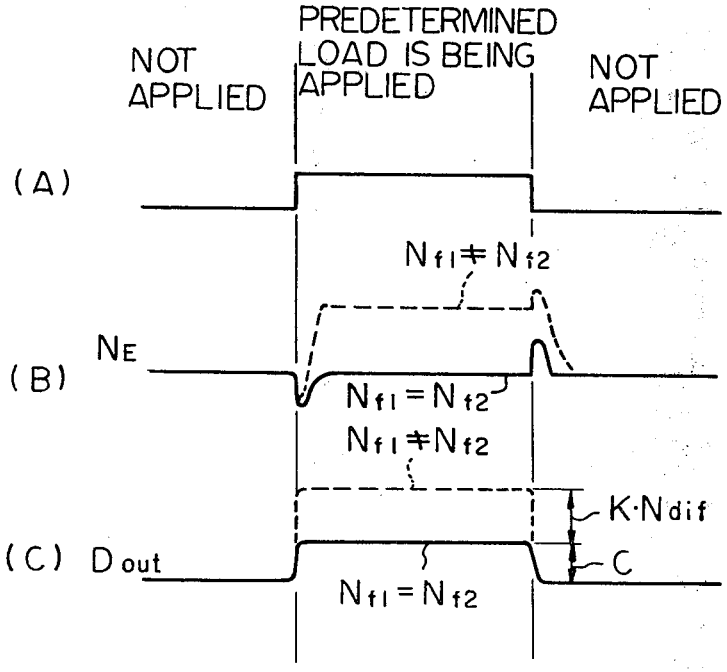
FIG. 4 contains three wave forms (A), (B) and (C) for illustrating the effects of the operation according to the program shown in FIG. 3.

According to the above-mentioned processing routine, when the predetermined load is exerted on the engine, the control output $D_{out}$ is increased, in addition to a predetermined increment of C by a quantity $K.N_{dif}$ which is proportional to the difference $N_{dif}$ between $N_{f1}$ and $N_{f2}$. When the load is removed, on the other hand, the control output $D_{out}$ is decreased by the quantity of $C+K.N_{dif}$. Accordingly, the rotational speed can be effectively prevented from overshooting when the load is applied or removed. FIG. 4 illustrates the above-mentioned states, in which (A) denotes a signal which indicates whether the load is applied or not (B) denotes the actual rotational speed $N_E$, and (C) denotes the control output $D_{out}$. As indicated by solid lines in (C), the control output $D_{out}$ is increased by the predetermined quantity of C when the load is applied under the condition in which $N_{f1}$ is equal to $N_{f2}$. Under the condition in which $N_{f1}$ is not equal to $N_{f2}$, the control output $D_{out}$ is further increased by the quantity of $K.N_{dif}$ when the load is applied. According to the conventional art, the control output $D_{out}$ is increased by a predetermined quantity, even when $N_{f1}=N_{f2}$ or when $N_{f1}\neq N_{f2}$. Therefore, the rotational speed tends to overshoot when the load condition is changed. However, according to the present invention, as shown in the diagram (B) of FIG. 4, the rotational speed does not overshoot even if $N_{f1}$ is not equal to $N_{f2}$ when the load condition is changed. The rotational speed $N_E$ is controlled so as to quickly acquire the first desired rotational speed $N_{f1}$ or the second desired rotational speed $N_{f2}$.

Figures 5, 5A:
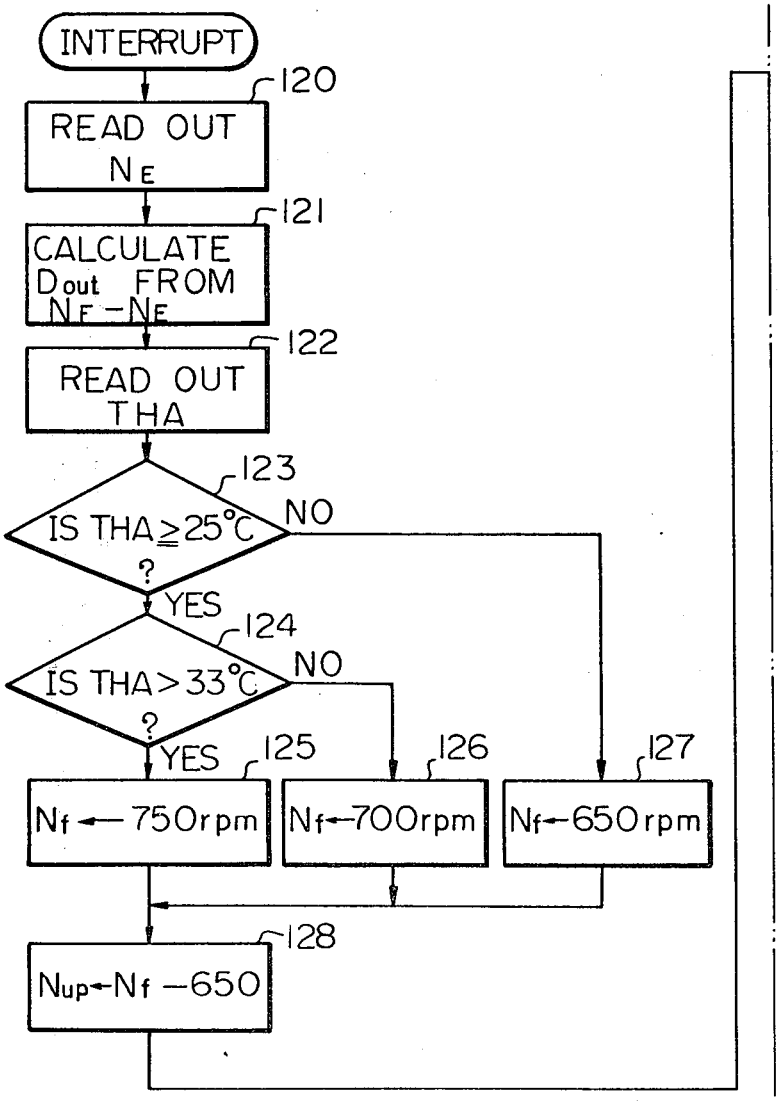
FIG. 5 is a flow diagram illustrating another operation of the digital computer in the control circuit of FIG. 2; and FIGS. *6a, 6b, 7a, 7b, 8a, 8b, 9a* and *9b* each contain wave forms for illustrating the effects of the operation according to the program shown in FIG. 5.
Figure 5B:
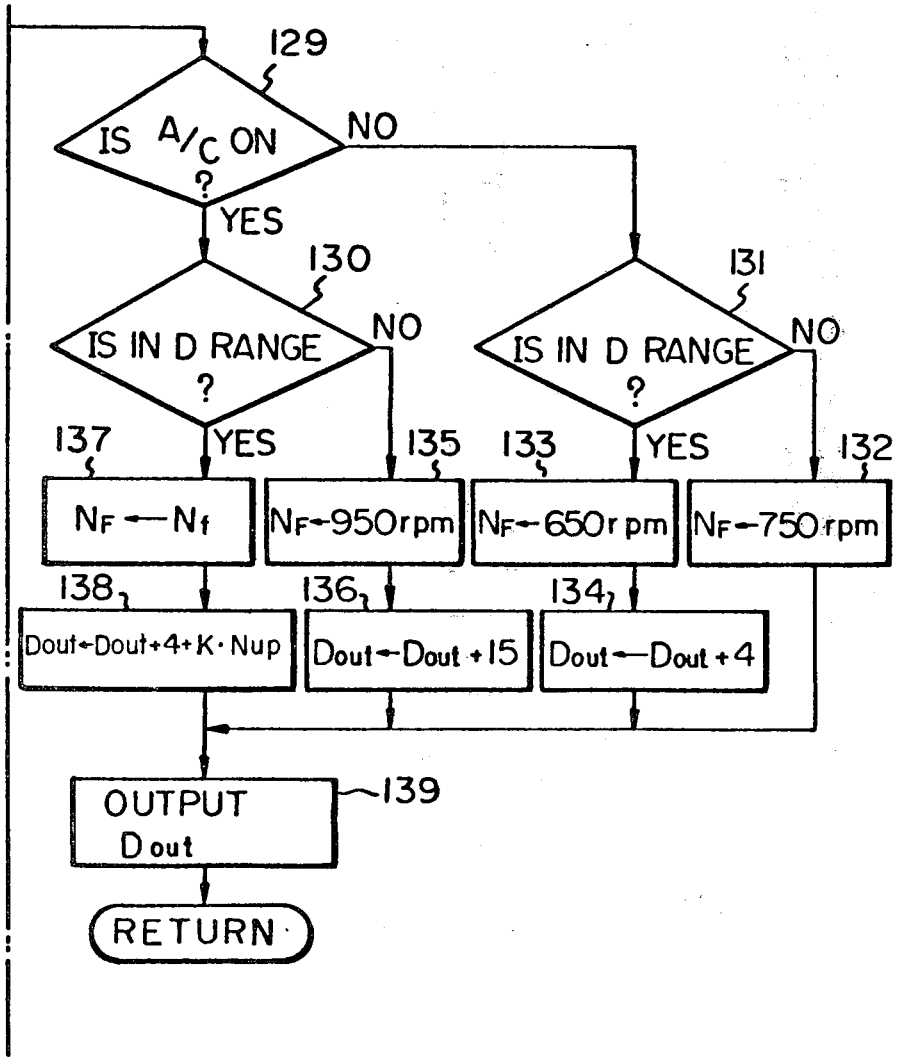
Figure 6A:
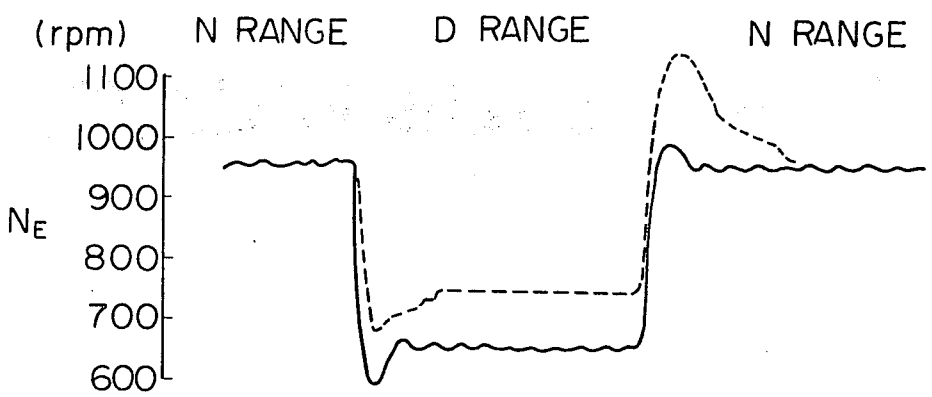
Figure 6B:
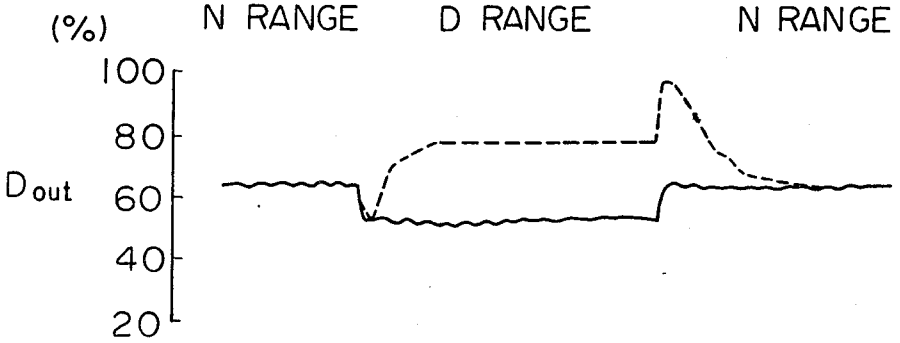
Figure 7A:
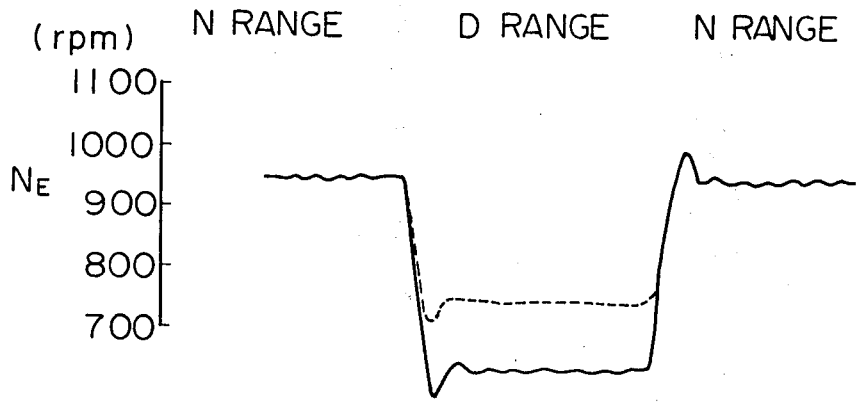
Figure 7B:
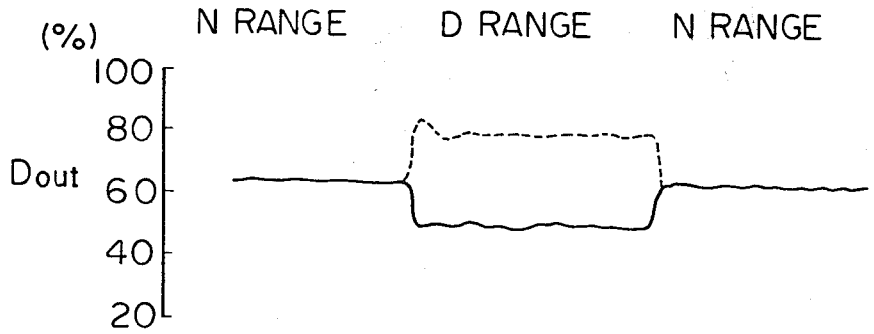
Figure 8A:
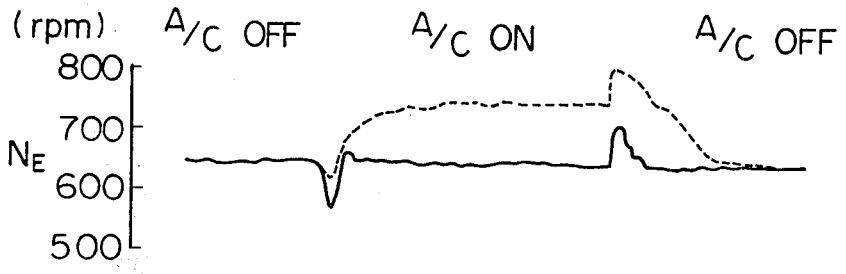
Figure 8B:
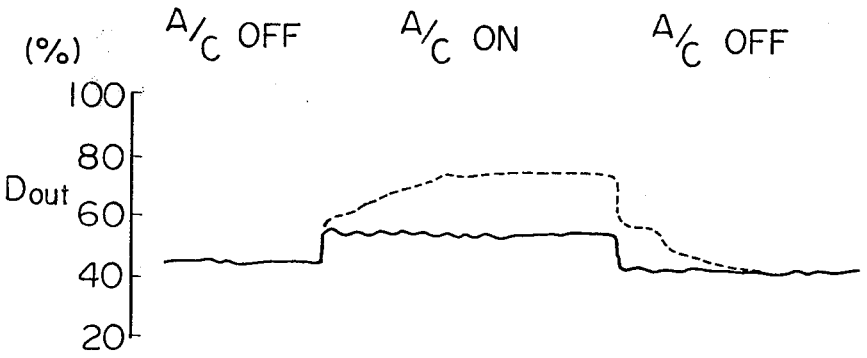
Figure 9A:
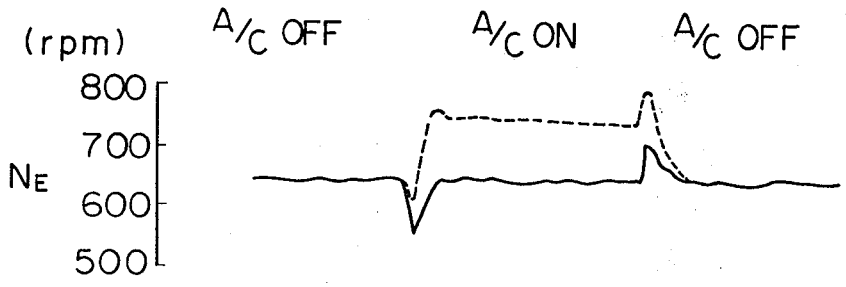
Figure 9B:
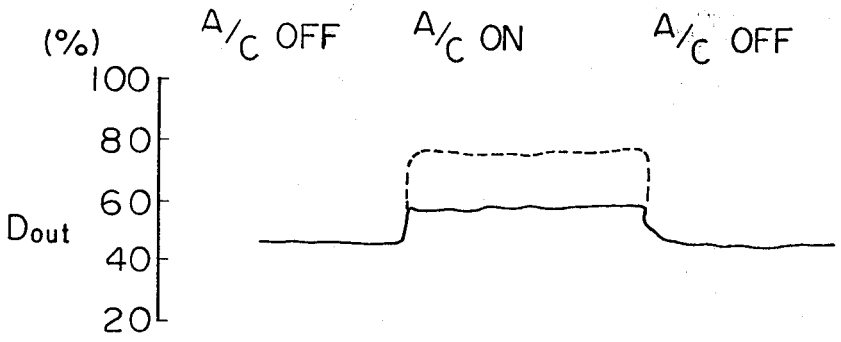

FIG. 5 illustrates another example of the interrupt processing program for calculating the control output $D_{out}$. This program calculates the control output $D_{out}$ under a condition where the air conditioner is operated or not operated, and the shift position of the automatic transmission is in the D range or in the N range. According to this example, however, the desired idling rotational speed $N_F$ varies depending upon the intake air temperature THA only when the air conditioner is operated and the transmission is being shifted in the D range.

The interrupt processing routine of FIG. 5 is also carried out at every predetermined period of time. Points 120 through 122 of this processing routine execute nearly the same processing as that of points 100 through 102 in the processing routine of FIG. 3. However, in this processing routine of FIG. 5, at the point 122 the CPU 82 reads out the detection data of the intake air temperature THA only. At points 123 through 127, the CPU 82 finds the desired idling rotational speed $N_f$ that is to be maintained when the air conditioner is operated and the transmission is shifted in the D range, as a function of the intake air temperature THA. When the intake air temperature THA is higher than 33° C., the desired rotational speed $N_f$ is set to 750 rpm. When 33° C.≧THA≧25° C., the desired rotational speed $N_f$ is set to 700 rpm. When 25° C.>THA, the desired rotational speed $N_f$ is set to 650 rpm.

At a point 128, the CPU 82 calculates the difference $N_{up}=N_f-650$ between the found desired rotational speed $N_f$ and the lower-limit value 650 rpm of $N_f$. In the processing routine of FIG. 5, the difference is calculated from $N_f-650$, because the desired idling rotational speed is maintained constant, except when the air conditioner is operated and also the transmission is shifted in the D range. At points 129, 130 and 131, the CPU 82 discriminates whether the air conditioner (A/C) is operated or not, and whether the transmission is being shifted in the D range or the N range. When the air conditioner is not operated and the transmission is shifted in the N range, the program proceeds to a point 132 where the reference rotational speed $N_F$ is set to 750 rpm. In this case, the control output $D_{out}$ is not increased. When the air conditioner is not operated and the transmission is in the D range, the processing of points 133 and 134 are executed. Namely, the reference rotational speed $N_F$ is set to 650 rpm, and the control output $D_{out}$ is increased by "4". When the air conditioner is operated and the transmission is in the N range, the processings of points 135 and 136 are executed. Namely, the reference rotational speed $N_F$ is set to 950 rpm, and the control output $D_{out}$ is increased by "15". When the air conditioner is operated and the transmission is in the D range, the program proceeds to a point 137 where the reference rotational speed $N_F$ is equalized to the previously found desired idling rotational speed $N_f$, and then the control output $D_{out}$ is increased by $4+K.N_{up}$ in the next point 138. The point 139 works in the same manner as the point 110 in the processing routine of FIG. 3.

According to the processing routine illustrated in FIG. 5, the control output $D_{out}$ is increased by "4" plus $K.N_{up}$ which corresponds to the desired idling rotational speed $N_f$, under the condition where the air conditioner is operated and the transmission is in the D range. Further, when the transmission is shifted from the N range to the D range while the air conditioner is operated, the control output $D_{out}$ is increased by $K.N_{up}-11$. When the transmission is shifted from the D range to the N range, on the other hand, the control output $D_{out}$ is decreased by $K.N_{up}-11$. When the air conditioner is switched to operate while the transmission is in the D range, furthermore, the control output $D_{out}$ is increased by $K.N_{up}$. When the air conditioner is switched to cut off, on the other hand, the control output $D_{out}$ is decreased by $K.N_{up}$.

FIGS. *6a, 6b, 7a, 7b, 8a, 8b, 9a* and *9b* illustrate the effects by the processing routine of FIG. 5 according to the present invention, i.e., they depict the actual rotational speed $N_E$ and control output $D_{out}$ characteristics found by experiments. FIGS. *6a* and *6b* illustrate the rotational speed $N_E$ and the control output $D_{out}$ according to the conventional art when the transmission is shifted in the order of N range→D range→N range while the air conditioner is being operated. FIGS. *7a* and *7b* illustrate the rotational speed $N_E$ and the control output $D_{out}$ when the processing routine of FIG. 5 is employed. FIGS. *8a* and *8b* illustrate the rotational speed $N_E$ and the control output $D_{out}$ according to the conventional art when the operation the air conditioner (A/C) is switched off—on—off, in sequence, during the transmission being shifted in the D range. FIGS. *9a* and *9b* illustrate the rotational speed $N_E$ and the control output $D_{out}$ when the processing routine of FIG. 5 is employed. When a reference rotational speed $N_F$ is set to 650 rpm while the air conditioner is being operated and the transmission is in the D range, no serious problem develops even with the conventional technique as shown by broken lines in FIGS. *6a* and *8a*. When a reference rotational speed $N_F$ is set to 750 rpm, however, considerable overshooting develops in the actual rotational speed $N_E$ causing the control operation to delay, as shown by solid lines in FIGS. *6a* and *8a*. According to the present invention, as illustrated in FIGS. *7a* and *9a*, however, the rotational speed $N_E$ can be smoothly and quickly controlled to assume a reference speed $N_F$ even when it is set to 650 rpm (solid lines) or 750 rpm (broken line).

It should be noted that, as shown in FIGS. *6b* and *7b*, when another load is applied or removed while the air conditioner is being operated (or while one load is being applied), the control output $D_{out}$ is not necessarily increased when such other load is applied (shifted from the N range to the D range) but may sometimes be decreased, and is not necessarily decreased when such other load is removed (shifted from the D range to the N range) but may sometimes be increased. The same also holds true in the case where the desired rotational speed changes as a function of the intake air temperature THA and the coolant temperature THW.

According to the present invention, as mentioned in detail in the foregoing, the quantity for additionally increasing or decreasing the flow rate of the intake air when the load is switched, is determined as a function of a desired idling rotational speed when a predetermined load is applied and a desired idling rotational speed when the predetermined load is not applied. Therefore, the rotational speed is not overshot when the load is switched, and the rotational speed can be quickly and smoothly controlled to acquire a desired value. Consequently, the driving feeling can be greatly improved.

As many widely different embodiments of the present invention may be constructed without departing from the spirit and scope of the present invention, it should be understood that the present invention is not limited to the specific embodiments described in this specification, except as defined in the appended claims.

I claim:

1. A method of controlling the air intake of an internal combustion engine having an intake passage, a throttle valve disposed in the intake passage, and an air bypass passage which interconnects the intake passage at a position located upstream of the throttle valve with the intake passage at a position located downstream of the throttle valve, said method comprising the steps of:

monitoring whether at least one predetermined load is applied to the engine, to produce at least one load discrimination signal which indicates the monitored result;

detecting the actual rotational speed of the engine to produce a rotational speed signal which corresponds to the detected rotational speed;

comparing said produced rotational speed signal with a variable reference rotational speed signal which indicates a desired idling rotational speed of the engine, to generate a control output signal for adjusting the bypassed section of the air bypass passage, said desired idling rotational speed being determined depending upon said load discrimination signal;

additionally changing, in response to said load discrimination signal, said control output signal by a value which corresponds to the difference between a first value related to a desired idling rotational speed when said predetermined load is applied to the engine and a second value related to a desired idling rotational speed when said predetermined load is not applied to the engine; and adjusting, in response to the control output signal, the sectional area of said air bypass passage to control the flow rate of air drawn through said air bypass passage so as to reduce the difference between the actual rotational speed signal and the reference rotational speed signal.

2. A method as claimed in claim 1, wherein said method further comprises steps of:

detecting one of the temperature of the coolant of the engine and the temperature of the intake air of the engine to produce a temperature signal which indicates at least one of the detected coolant temperature and the detected intake air temperature, respectively; and determining a desired idling rotational speed depending upon said produced temperature signal as well as upon said load discrimination signal.

3. A method as claimed in claim 1, wherein said monitoring step includes a step of monitoring whether an air conditioner attached to the engine is operating, to produce a load discrimination signal.

4. A method as claimed in claim 1, wherein said monitoring step includes a step of monitoring whether the shift position of a transmission of the engine is selected in the drive range or the neutral range.

5. A method as claimed in claim 1, wherein said comparing step includes a step of calculating a value of the control output signal from the difference between the desired idling rotational speed and the actual rotational speed.

6. Apparatus for controlling the air intake of an internal combustion engine having an intake passage and a throttle valve disposed in the intake passage comprising:

an air bypass passage which interconnects the intake passage at a position located upstream of the throttle valve with the intake passage at a position located downstream of the throttle valve;

means for producing at least one load discrimination signal when at least one predetermined load is applied to the engine;

means for producing a rotational speed signal related to the actual rotational speed of the engine;

controlling means for (1) determining a desired idling rotational speed signal related to said load discrimination signal, (2) comparing said produced speed signal with said desired rotational speed signal, to generate a control output signal for adjusting the bypassed section of the air bypass passage, and (3) additionally changing, in response to said load discrimination signal, said control output signal by a value which corresponds to the difference between a first value related to a desired idling rotational speed when said predetermined load is applied to the engine and a second value related to a desired idling rotational speed when said predetermined load is not applied to the engine; and means for adjusting, in response to the control output signal, the sectional area of said air bypass passage to control the flow rate of air drawn through said air bypass passage so as to reduce the difference between the actual rotational speed signal and the desired rotational speed signal.

7. Apparatus as in claim 6, wherein:

said apparatus further comprises means for producing a temperature signal related to at least one of the coolant temperature and the intake air temperature; and said control means determining function determines said desired idling rotational speed depending upon said produced temperature signal as well as upon said load discrimination signal.

8. Apparatus as in claim 6, wherein:

said engine is in a vehicle having an air conditioner; and said load signal producing means includes means for monitoring whether said air conditioner is operating, to produce said load discrimination signal.

9. Apparatus as in claim 6, wherein:

said engine is in a vehicle having a transmission with a neutral range and a drive range; and said load signal producing means includes means for monitoring whether said transmission is selected in the drive range or the neutral range.

10. Apparatus as in claim 6, wherein said controlling means comparing function determines a value of the control output signal from the difference between said desired idling rotational speed and said actual rotational speed.

* * * * *